US005685208A

United States Patent [19]

Tidwell

[11] Patent Number: 5,685,208

[45] Date of Patent: Nov. 11, 1997

[54] TOOL SYSTEM WITH LOCKING HANDLE

[76] Inventor: Harvel J. Tidwell, 9719 Old Bon Aqua Rd., Bon Aqua, Tenn. 37025

[21] Appl. No.: 635,626

[22] Filed: Apr. 22, 1996

[51] Int. Cl.[6] ..... B25B 23/16

[52] U.S. Cl. ..... 81/177.85; 81/177.2; 403/322

[58] Field of Search ..... 81/124.4, 177.2, 81/177.85; 403/322, 325

[56] References Cited

U.S. PATENT DOCUMENTS

| | | | |
|---|---|---|---|
| 1,626,906 | 5/1927 | Zilliox | 81/177.85 X |
| 1,660,989 | 2/1928 | Carpenter | 81/177.85 X |
| 2,832,246 | 4/1958 | Livermont | 81/177.85 X |
| 4,781,085 | 11/1988 | Fox, III | 81/177.85 |
| 4,829,857 | 5/1989 | Jones | 81/177.1 |
| 4,865,485 | 9/1989 | Finnefrock | 403/322 |
| 4,938,107 | 7/1990 | Nickipuck | 81/177.85 |
| 4,962,682 | 10/1990 | Rose | 81/177.85 |
| 5,289,745 | 3/1994 | Beardsley | 81/177.2 |
| 5,333,523 | 8/1994 | Palm | 81/177.85 |

*Primary Examiner*—James G. Smith

[57] ABSTRACT

A hand tool comprising a handle (30) with handle ends (10) to which may be attached tool ends (40 & 44) of predetermined sizes for performing predetermined functions. The handle ends (10) and the tool ends (40 & 44) have matching ways (13 & 47) for slidably joining the tool ends (40 & 44) to the handle ends (10). The tool ends (40 & 44) are locked to the handle ends (10) by the use of a spring loaded ball (33) and a locking ball (20) controlled by a push rod (18) having recessed areas for containing and for locking the ball (20) to the adjacent handle end ways (13) and to the tool end ways (47).

3 Claims, 3 Drawing Sheets

SECTION 6 - 6

SECTION 7 - 7

TOOL SYSTEM WITH LOCKING HANDLE

BACKGROUND—FIELD OF THE INVENTION

This invention relates to hand tools, and particularly to hand tools which utilize a detachable handle suitable for accommodating a variety of tools.

BACKGROUND—DESCRIPTION OF PRIOR ART

Tools which have detachable parts are well-known in prior art. Such tools are widely used by mechanics because the separability of the tool parts offers several advantages. Separability of the parts allows the user to configure the tool for a particular task. Mechanics are often required to work in confined spaces, and using a separable handle with a variety of interchangeable tool ends allows the mechanic to work in such confined spaces with a minimum of effort. Secondly, since a single handle may be used with a wide variety of tools, the cost of a complete set of tools is reduced. Thirdly, materials may be used for the interchangeable tools which would not be suitable for use in the handle, due to excessive cost or difficulty of manufacture.

Although the advantages of using separable parts are widely recognized, securely attaching the parts has proven difficult. Many of the methods for attaching the tool end to the handle end have been developed for use with socket wrenches. Socket wrenches, as commonly designed, utilize a spring-actuated ball catch to hold the socket onto the handle. In these typical designs, a spring and ball are set into an opening on one or more of the sides of the handle, and the diameter of the opening at the surface of the side is thereafter reduced so as to retain the ball within the opening while still allowing a portion of the ball to protrude from the surface of the handle side. When the handle is inserted into the socket, the ball is forced farther into the opening, compressing the spring. When the handle is fully inserted into the socket, the ball is able to protrude into a recess on the inside surface of the socket. To remove the socket, sufficient force must be applied to compress the spring and push the ball into the opening.

This design is generally effective since the force applied to the wrench handle while using it to tighten or loosen bolts does not tend to pull the socket away from the handle. However, when the user attempts to withdraw the socket from the nut or bolt on which it has been used, the force applied will tend to pull the socket from the handle. This can be a great inconvenience to the mechanic, and is a particular problem when a drive extension has been used to permit access to an otherwise inaccessible area. Therefore, a number of locking designs have been introduced to overcome the deficiencies of the simple spring-activated ball catch mechanism.

Several of the locking mechanisms designed for use with socket wrenches utilize a rod or wedge which can be moved into a position to prevent the ball from being pushed back into the opening. U.S. Pat. No. 4,781,085 to Fox (1988) discloses a sliding rod located axially within a socket drive extension. In its normal position, the rod extends into the opening and prevents the ball from being pushed into the opening. The rod can be manually retracted so that it no longer intrudes into the opening, thus allowing the ball to retract. U.S. Pat. No. 4,865,485 to Finnefrock (1989) discloses a sliding rod design similar to that of Fox, but utilizing a two-part rod intended to automatically compensate for changes in the diameter of the ball due to wear.

Another sliding rod design is disclosed in U.S. Pat. No. 5,289,745 to Beardsley (1994). This design for a socket drive extension utilizes a rod which is moved into position to secure the socket when the extension is attached to the handle. Thus, to remove the socket from the extension, it is necessary to remove the extension from the handle.

In U.S. Pat. No. 4,962,682, Rose (1990) discloses a design which replaces the rod with a series of balls, which are maintained in contact with one another by the small size of the chamber in which the balls are contained. Normally, the balls are not able to move freely within the drive extension, and the last ball in the series, which protrudes from the opening and prevents the socket from being withdrawn, is prevented from retracting into the opening. A manually operated button, when depressed, increases the space available in the opening and allows the balls to move, thus releasing the socket. This design, although simple in its use of few parts, would be very difficult to manufacture due to the location and complex shape of the internal chamber within the drive extension. Moreover, the device would fail to work properly if the series of balls were to become contaminated by dirt or other substances which might prevent the balls from moving easily within the chamber.

U.S. Pat. No. 4,938,107 to Nickipuck (1990) discloses a locking method which, instead of utilizing the typical spring-loaded ball catch mechanism, uses an opening which passes completely through the drive extension. This opening contains two balls, which are of a size such that when one ball is pressed into the opening, the other ball is prevented from retracting into the opening. The device utilizes an external sleeve surrounding the drive extension, which normally presses one ball into the opening, but which can be manually withdrawn to allow both balls to move, thus allowing the socket to be inserted onto or removed from the drive extension. A simplified version of this design was disclosed by Palm (1994) in U.S. Pat. No. 5,333,523.

Both the Nickipuck and Palm designs are generally adequate for use with the larger sizes of socket drive extensions, but would be unsuitable for use in the smaller half inch, three-eighths inch, and quarter inch sizes which are more common. The complexity of the mechanism would require extremely precise manufacture of the components at the smaller sizes, resulting in a device which is prohibitively expensive.

Although socket wrenches are perhaps the most widely-used tool in which the handle is separable, there are many other types of tools in which the separability of the handle is an advantage. The need for a locking mechanism and a secure attachment between the handle and tool is a general problem affecting a wide variety of tools.

U.S. Pat. No. 4,829,857 to Jones (1989) discloses a spring-actuated catch mechanism by which a handle may be attached to a tool. The Jones design is intended to prevent a cylindrical handle end from being pulled out of a cylindrical recess in the tool. When the handle has been fully inserted into the tool, a spring forces a pin contained within the handle to protrude into a recess in the tool, thus locking the handle in place. However, the Jones design is deficient in several respects. The extreme forces that can be exerted upon the junction of the tool and handle will tend to distort the cylindrical shapes of the handle and tool, and the difficulty of assembling the spring-actuated catch mechanism within the cylindrical handle will result in high costs of manufacture. Moreover, inertial forces may cause the spring to compress, allowing the catch mechanism to release the tool from the handle during use and resulting in a risk of injury.

Although tools with separable handles offer many advantages, their widespread acceptance has been limited by the inherent weaknesses of the attachment methods previously available. The junction must be capable of withstanding extreme forces, which may be exerted by the user in a wide variety of directions. Various locking mechanisms have been developed for use with socket wrenches, but these methods are not appropriate for other types of hand tools.

OBJECTS AND ADVANTAGES

Accordingly, several objects and advantages of the present invention are (a) to provide a tool handle, having ends into which a variety of tool ends can easily be attached;

(b) to provide a separable tool handle to which tool ends can be easily attached to each end of the handle;

(c) to provide a separable tool handle which will allow the user to configure the tool to the task at hand;

(d) to provide a separable tool handle which will securely hold tools under a wide range of usage conditions;

(e) to provide a separable tool handle utilizing a method for attaching tools to handles which can be economically manufactured in a wide range of sizes;

(f) to provide a separable tool handle utilizing a method of attaching tools to handles which will not easily be disabled or jammed by dirt or other contaminants;

(g) to provide a variety of tool ends having complementary ways for easily being securely attached to matching handle ends.

Still further objects and advantages will become apparent from a consideration of the ensuing description and drawings.

DRAWING FIGURES

REFERENCE NUMERALS IN DRAWINGS

Figure 4:
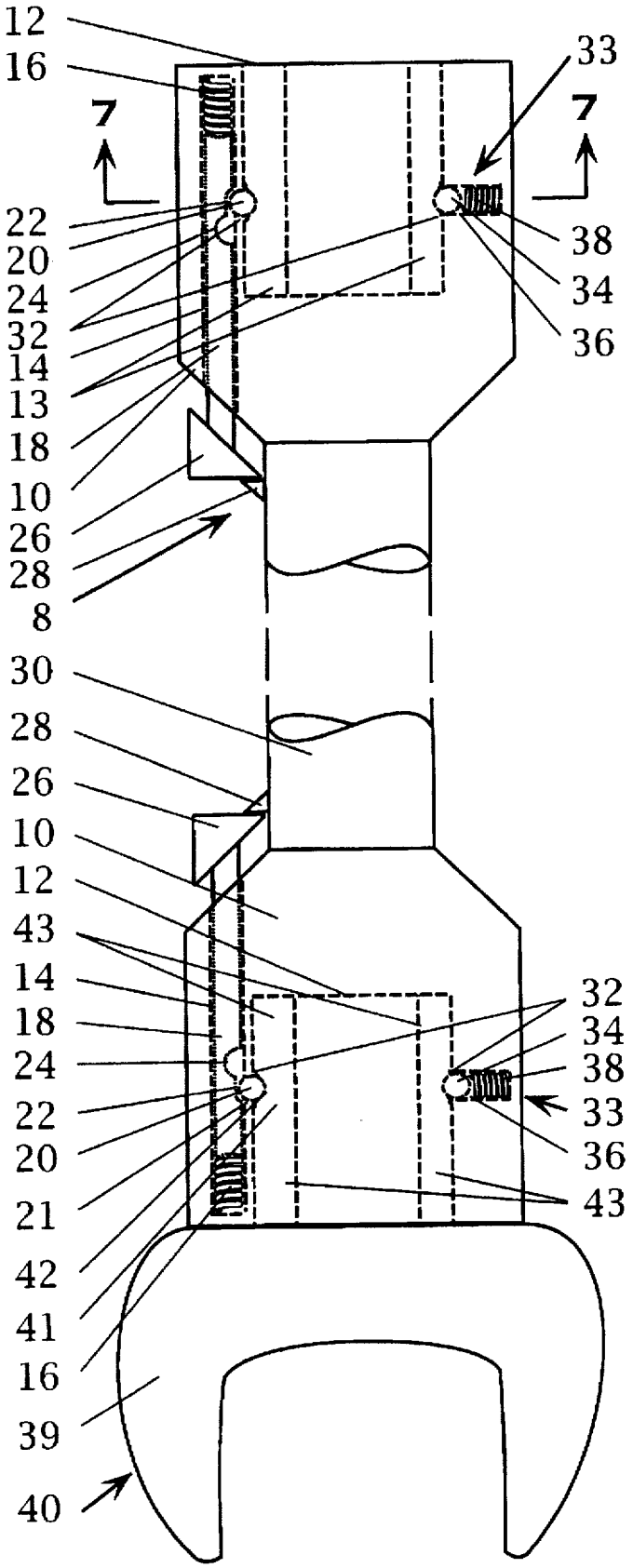
FIG. 4 shows a tool handle and handle ends with ways, and locking mechanisms at each handle end. The lower handle end contains a tool, with its matching ways in juxtaposition with the handle end ways.

8 fastening tool
10 handle end
12 recess on handle end of fastening tool
13 ways of handle end
14 cylindrical channel in tool handle
16 compression spring
18 rod
20 hard ball
21 opening, extending from recess 12 to channel 14
22 shallow concavity in surface of rod 18
24 larger concavity in surface of rod 18
26 enlarged end of rod 18
28 detent formed on handle
30 handle
32 upset metal restricting openings 21 and 36
33 standard spring actuated bah catch mechanism
34 hard ball
36 opening, extending from recess 12
38 compression spring
39 open-end wrench tool
40 open-end wrench tool end FIG. 4
41 tang of tool end 40
42 concavity on tang 41
43 ways of tool end 40
44 closed-end wrench tool end (FIG. 5)
45 tang of tool end 44
46 concavity of tang 45
47 ways of tool end 44

Description—FIGS. 1 to 7

A preferred embodiment of this invention is shown in FIG. 4, which shows a handle having two ends 10, each of which incorporates a locking mechanism. A tool end 40 is shown inserted into one of the handle ends 10 and locked into position by ball 20 which is protruding into a concavity 42 located on tang 41 of tool end 40.

Figure 1:
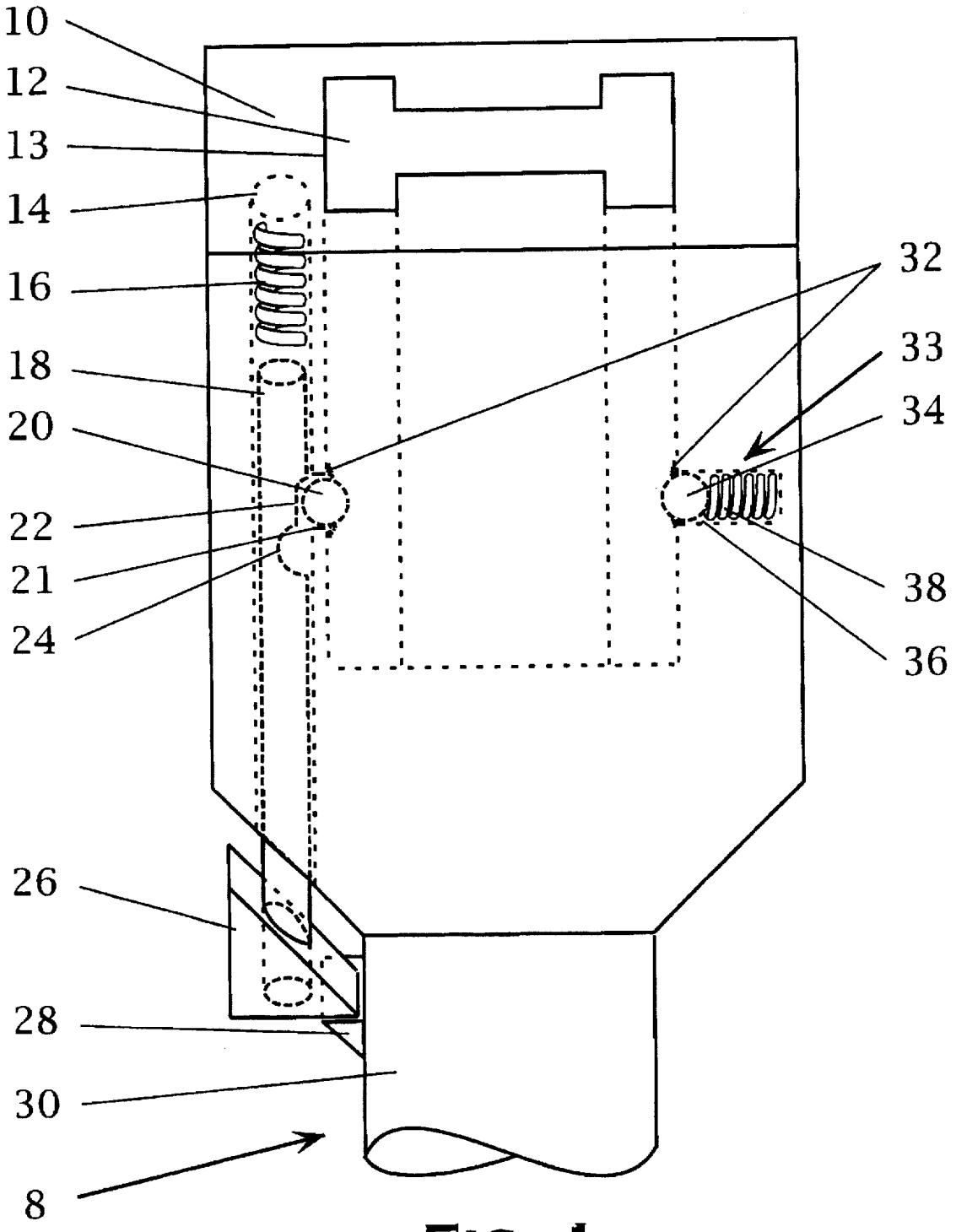
FIG. 1 is a perspective view which shows the end of a tool handle with its ways, and the interior parts which comprise the locking mechanisms.

The locking mechanism incorporated in this invention is shown in FIG. 1. The handle end 10 of the fastening tool 8 has a recess 12 into which a tool end (See 40 & 44) may be inserted. A cylindrical channel 14 extends into the handle end 10 and is parallel to recess 12. An opening 21 is perpendicular to the axis of handle end 10 and extends from the recess 12 to channel 14. A compression spring 16 is inserted into channel 14. A cylindrical rod 18 having an enlarged end 26 is inserted into channel 14, partially compressing spring 16. The enlarged end of rod 26 presses against an upset metal detent 28 formed at a predetermined place on the surface of handle 30, which prevents rod 18 from completely exiting channel 14. A hard ball 20, inserted into opening 21 through recess 12, presses against rod 18 at a point on rod 18 which contains a shallow concavity 22. Ball 20 is secured within opening 21 by a concave area 32 on the interior surface of end 10 in the area surrounding opening 21. A standard spring-actuated ball catch mechanism 33, consisting of a ball 34 and a spring 38 positioned within a circular opening 35, is located in handle end 10 such that opening 35 is co-axial to opening 21.

Figure 2:
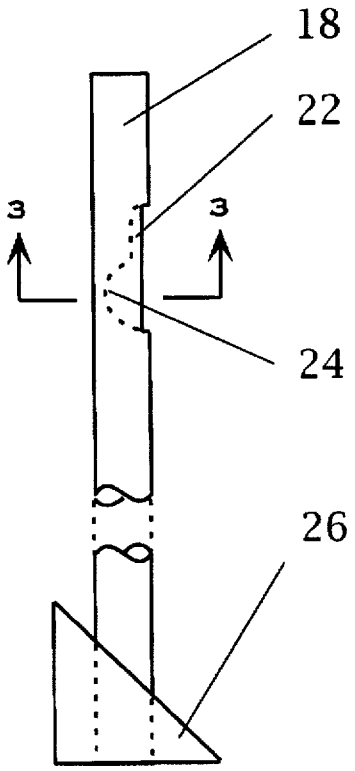
FIG. 2 shows a rod which has two adjacent concavities formed in one side to accommodate a ball.

Rod 18 is shown in more detail in FIG. 2. A shallow concavity 22 is formed on rod 18 adjacent to a larger concavity 24. The depth and shape of shallow concavity 22 is predetermined to allow ball 20 to fill shallow concavity 22 while protruding into recess 12. The depth and shape of larger concavity 24 is predetermined to allow ball 20 to fill larger concavity 22 while not protruding into recess 12, to permit insertion or release of tool ends.

Figure 3:
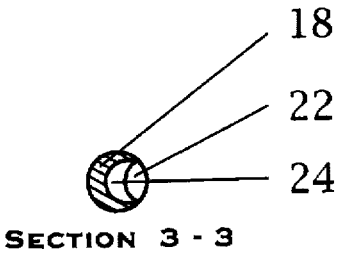
FIG. 3 is a cross section of the rod taken at 3—3 in FIG. 2.

A cross section of rod 18 taken at C—C is shown in FIG. 3, showing the relative sizes and locations of the larger concavity 24 and the shallow concavity 22.

Figure 5:
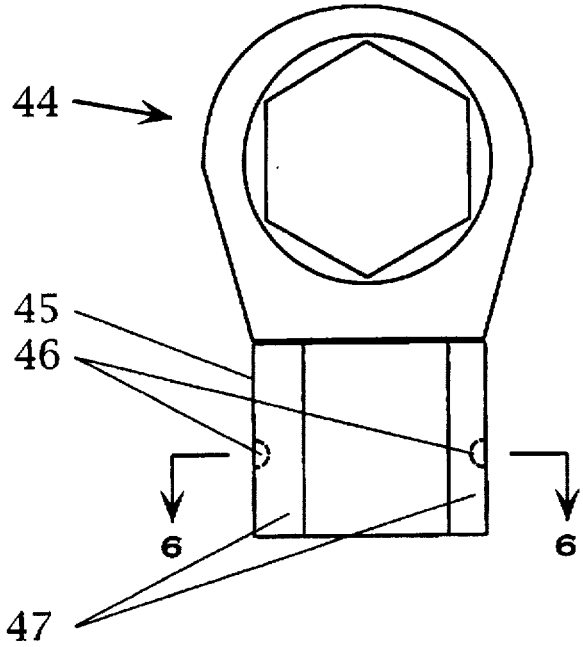
FIG. 5 shows a tool end with slidable ways, which is suitable for use with the handle, having concavities at a predetermined location on the tool ways to accommodate the locking mechanism.

FIG. 5 shows a typical tool end 44, in this case a closed-end wrench, having ways 47 on tang 45 which can be inserted into a handle end. Also shown are the location of concavities 46, which are of a size and location predetermined to match the size and location of ball 20 when tang 45 is fully inserted into handle end 10.

Figure 6:
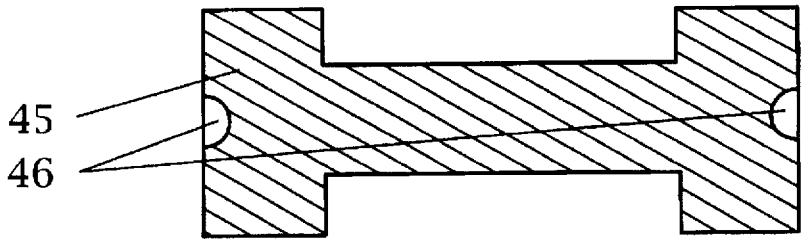
FIG. 6 shows a cross section of the tang of the tool taken at 6—6 in FIG. 5.

FIG. 6 shows a cross section of the tool end tang 45 taken at B—B in FIG. 5. Also shown are the locations and shapes of the concavities 46 on the tool end tang.

Figure 7:
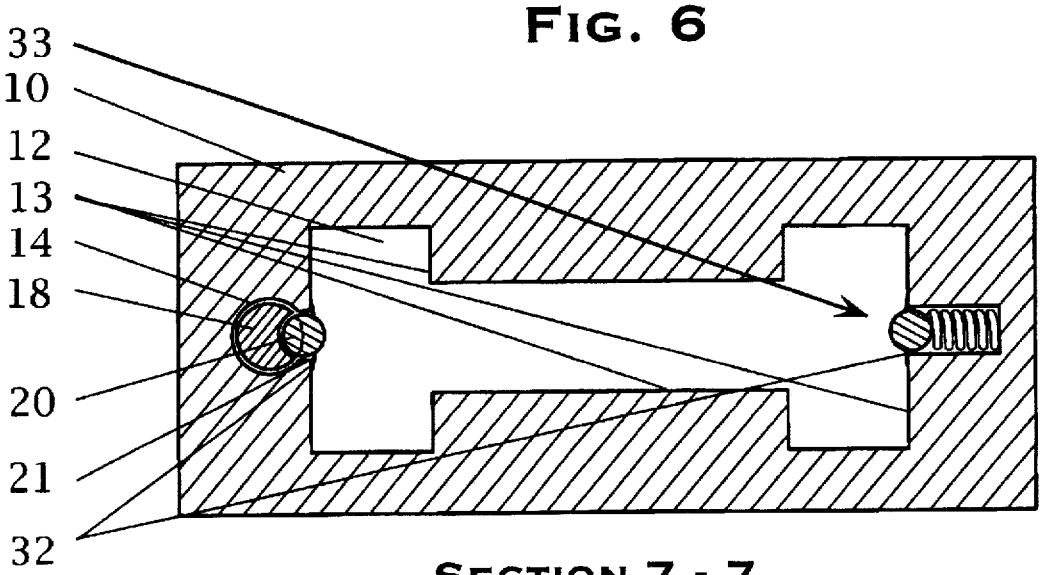
FIG. 7 shows a cross section of the handle taken at 7—7 in FIG. 4.

FIG. 7 shows a cross section of handle end 10. The ball 20 is shown in opening 21, protruding into recess 12 and filling shallow concavity 22 on rod 18. The interior of recess 12 has been peened, stamped, or pressed in the areas of opening 21 and opening 36 so as to retain ball 20 and ball 34 within openings 21 and 36 respectively.

Also shown in FIGS. 1, 4 and 6, for purposes of comparison, is a standard spring-activated ball catch mechanism 33. The inclusion of the standard ball catch 33 improves the performance of the handle by providing a positive pressure related to the spring 38 which causes the tang 41 in FIG. 4 to stay more firmly seated against the interior surface of end 10 in the vicinity of ball 20.

The midpart of handle 30 is shown in FIG. 4 as being cylindrical, but the actual shape of the handle midpart, or its length or material of manufacture, is incidental to the design. The tool handles and tool ends shown herein may be made of iron, steel or other materials having appropriate hardness, malleability and durability. Similarly, recess 12 in the handle end is shown as having twelve sides, but it should be apparent that the recess could have a variety of shapes suited to accommodate a set of tool ends. The figure is intended to show only one preferred embodiment of the design herein described.

Operation

The manner of using the tool handle is best illustrated with reference to FIG. 4, and is described as follows: a tool end 40 is selected for insertion into the handle end 10, and the tang 41 of tool end 40 is inserted partially into recess 12 on handle end 10. The tang 41 cannot be inserted completely into recess 12 because ball 20 protrudes into the recess and resists the insertion of tang 41. The user manually presses against the enlarged end 26 of rod 18, compressing spring 16 and moving rod 18 so that the larger concavity 24 on rod 18 is adjacent ball 20. This allows ball 20 to retract into opening 21, so that ball 20 no longer protrudes into recess 12, thus permitting tang 41 to be completely inserted into the recess.

The user next releases the manual pressure against the enlarged rod end 26, allowing spring 16 to decompress and allowing rod 18 to return to its normal position. When rod 18 assumes its normal position, the shallow concavity 22 in the surface of rod 18 is adjacent ball 20, and ball 20 is unable to retract. The tool end 40 is now securely held within recess 12 by ball 20 which is protruding into recess 12 and into the adjacent concavity 42 located on tool tang 41.

Once the tool end 40 has been securely attached and locked into position, the tool is ready for use. The slidable ways 43 of tool end 40 are securely held in juxtaposition with the matching ways 13 of handle end 10 by ball 20. The multiple areas of surface contact provided by the matching ways provide a secure attachment which will resist the forces which would otherwise tend to separate the tool end from the handle.

To remove the tool from the handle, the user manually presses the enlarged end 26 of rod 18 so as to compress spring 16 and move the larger concavity 24 of rod 18 to a position adjacent to ball 20. In this position, ball 20 is able to retract into opening 21 so that ball 20 no longer protrudes into recess 12 and no longer resists the movement of tool tang 41 within recess 12. The user may now manually withdraw tool end 40 from recess 12.

Summary, Ramifications and Scope

Accordingly, the reader will see that the tool herein described can be used with a wide variety of tool ends, and thus offers the advantages that the separability of the tool provides—efficiency of use, economy of manufacture, and wider choice of materials.

The matching ways, which allow the insertion of the tool end into the handle end, provide a very secure attachment which, in combination with the locking mechanism, will ensure that the tool is held securely during use.

The locking mechanism described herein offers several advantages over the mechanisms previously developed for use with socket wrenches. It is economical to manufacture, requiring no complex machining operations. It has very few moving parts, and these parts are enclosed and much less subject to contamination than in previous designs.

Tool ends that may be attached to the handle ends of this fastening tool include: end wrenches, closed-end wrenches, open-end wrenches, monkey wrenches, combination wrenches, adjustable wrenches, ratchet wrenches, and others. Yet the tool is not Limited to use with wrenches. The matching ways and locking mechanism described herein provide a secure attachment of a wide range of tool ends to the handle, which will resist the extreme twisting, pulling and pushing forces that can be applied to hand tools.

The invention is novel is its solution to the problem of securely attaching a tool end to a handle. The utility of the invention results from the great economy that can be obtained by using the same handle with a variety of tool ends. The simple and robust design of the locking mechanism can be economically manufactured in a range of sizes. Yet there is nothing obvious about the design; the recent prior patents related to socket wrench drive, cited herein, attest to the need for such a mechanism. The invention herein disclosed has simply solved the general problem of attaching handles to tool ends in a more secure and economical manner.

Although the description of the invention has used several illustrations to show a preferred embodiment of the invention, these illustrations should not be construed as limiting the scope of the invention. Rather, the scope of the invention is to be determined by the appended claims, or their legal equivalents.

I claim:

1. A manual fastening tool comprising a a tool end for accommodating the usage of fasteners, b an elongated handle, c a handle end integral to said handle for accommodating the usage of said tool end, d slidable ways, on said tool end, e a concavity, of predetermined size and location, on the slidable ways of said tool end, matching slidable ways on said handle end whereby said tool end fits inside said handle end and is slidably adjoined to said handle end.

g means for releasably locking said tool end to said handle end, wherein said locking means located on the handle end comprises a' a locking ball of predetermined size, b' a push rod of predetermined size and length, having a" shallow concavity of predetermined size and location on said rod, b" a large concavity of predetermined size and location on said rod, c" an enlarged end of said rod of predetermined size and shape, c' a compression spring of predetermined size and elasticity, d' a closed end cylindrical channel, integral to said handle end, having an opening presized for containing said spring and said push rod, e' a detent of predetermined size and shape, integral to said handle end and at a predetermined location on said handle end, wherein said channel contains said spring at the dosed end of the channel; said channel contains that portion of the push rod exclusive of the enlarged end of said push rod; the enlarged end of said push rod contacts said detent; said locking ball is positioned in the shallow concavity on said push rod and partially extends into said concavity on said tool end, thereby locking said tool end to said handle end; whereby a manual force of a predetermined amount against said enlarged end of the push rod causes said spring to contract in length and moves said large concavity on said push rod to a position in register with said concavity on said tool end, permitting said locking ball to be completely contained in said large concavity of the push rod, thereby releasing the locking means for manually removing said tool end from said handle end.

2. The tool of claim 1, wherein said tool end is a tool component selected from the group consisting of open end wrenches and box wrenches and socket wrenches and monkey wrenches and combination wrenches and ratchet wrenches and assorted hand wrenches.

3. The tool of claim 1 wherein said matching slidable ways and said releasable locking means are located on each of said handle ends.

* * * * *